United States Patent [19]

Ball

[11] 4,057,921

[45] Nov. 15, 1977

[54] DECORATIVE DEVICE

[76] Inventor: Derek William Ball, 6 Ellerton Way, Karori, Wellington, New Zealand

[21] Appl. No.: 689,036

[22] Filed: May 24, 1976

[30] Foreign Application Priority Data

Apr. 13, 1976 New Zealand ..... 180594

[51] Int. Cl.[2] ..... G09F 13/24

[52] U.S. Cl. ..... 40/106.21

[58] Field of Search ..... 40/106.21, 106.22; 272/8 R; 240/10 A

[56] References Cited

U.S. PATENT DOCUMENTS 3,706,149 12/1972 Olivieri ..... 40/106.22

FOREIGN PATENT DOCUMENTS 703,924 2/1954 United Kingdom ..... 40/106.21

OTHER PUBLICATIONS

Young, IBM Disclosure Bulletin, vol. 6, No. 3, 8-1963, pp. 22.

*Primary Examiner*—John F. Pitrelli

*Attorney, Agent, or Firm*—Holman & Stern

[57] ABSTRACT

A decorative device for displaying overlapping colors both in a static symmetrical configuration and in a kinetic, random and constantly changing pattern. It takes advantage of shades obtainable when a transparent or translucent layer of one color overlaps another. The device consists of at least two sheet-like chambers in face to face relationship. In each chamber there are at least two immiscible fluid phases of different specific gravities each of a different color although optionally including a colorless phase. Preferably there are two chambers of two phases each, one phase being colorless and the other three phases being colored the three primary colors.

7 Claims, 3 Drawing Figures

DECORATIVE DEVICE

BACKGROUND OF THE INVENTION

1. Field of Invention

This invention relates to a decorative device for displaying overlapping colors in either a static predetermined configuration or else in a kinetic, random and constantly changing pattern.

2. Description of the Prior Art

U.S. Pat. No. 3,564,740 relates to a fluid novelty device where immiscible phases of different specific gravities are colored with different colors. However, in each of the embodiments illustrated and claimed there is provided at least one port between adjacent chambers whereby fluid may flow from one chamber to another. There is not described any sheet-like flow of different colored fluids in separate adjacent chambers creating mixing of colors.

In U.S. Pat. No. Re. 23,216 there is described and claimed a toy device comprising a hollow spherical housing wherein transfer of fluids occurs. Similarly there is neither disclosed nor claimed any sheet like flow of fluids in adjacent chambers from one another.

In U.S. Pat. No. 2,589,757 there is illustrated a toy device wherein fluid is transferred from chamber to chamber.

In U.S. Pat. No. 3,101,564 there is illustrated a display device which utilizes a stream of moving bubbles within a liquid filled transparent chamber preferably provided with back lighting.

SUMMARY OF THE INVENTION

It is an object of this invention to provide a color display device of greater simplicity than of known devices by taking advantage of color mixing which can be created through the overlapping of other colors.

Other objects and advantages of the invention will be apparent from the following description.

Accordingly the invention may broadly be said to consist in decorative device comprising:

- a pair of sealed sheet-like chambers in face to face relationship, the major faces of each said chamber being transparent or at least translucent, a pair of mutually immiscible fluid phases of different specific gravities provided in each said chamber, and,
- a coloring substance homogeneously dissolved in at least one said phase, said coloring substance being insoluble in the other fluid phase in its chamber, the arrangement being such that when said device is at rest there is created a static display of predetermined color combinations and when said apparatus is inverted there is created a kinetic superimposition of irregular images of patterns as each of said pairs of phases returns to equilibrium.

DESCRIPTION OF THE PREFERRED EMBODIMENT

Figure 2:
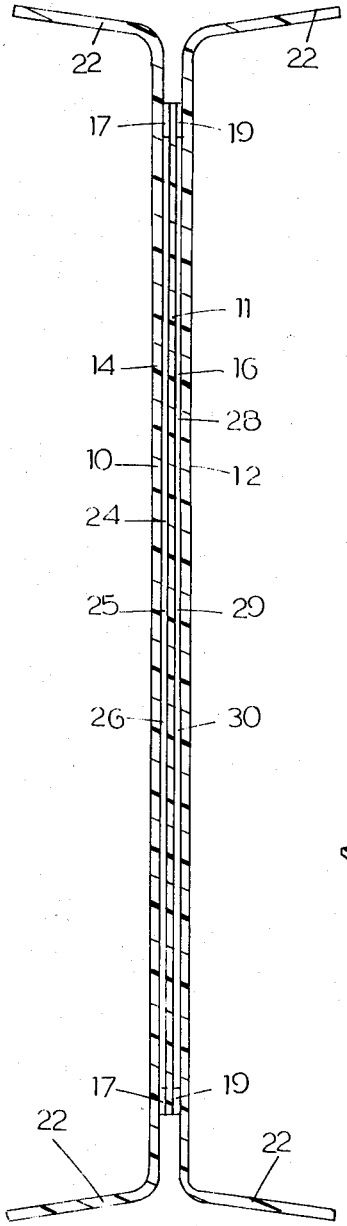
FIG. 2 is the section II—II shown in FIG. 1 and illustrated on an enlarged scale for clarity.
Figure 1:
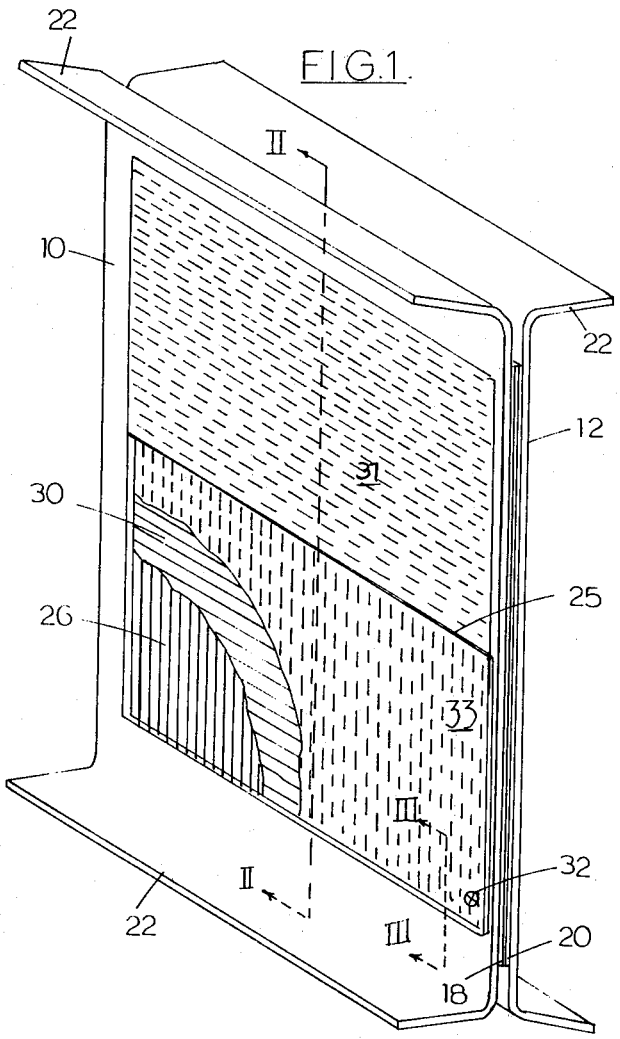
FIG. 1 is an isometric view of the apparatus according to the invention with a portion shown broken away.

The preferred embodiment of the invention consists in first and second outer sheets 10 and 12 respectively and a central dividing sheet 11. Between these sheets there are defined a first enclosed chamber 14 and a second enclosed chamber 16. The chambers are completed by the provision of horizontal spacing strips 17 and 19 and vertical spacing strips 18 and 20 as shown in FIG. 1. For convenience there are provided extensions 22 of outer first and second sheets 12 defining feet upon which the apparatus may be stood. It will be seen that these feet are operable to retain the apparatus in an upright position whenever it is inverted. It will be appreciated that the feet 22 are an optional feature and that the apparatus could be retained in an upright position in some form of stand or other retaining device.

Figure 3:
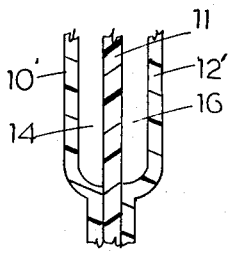
FIG. 3 is a fragmentary section of an alternative embodiment corresponding to the section III—III shown in FIG. 1.

In the alternative embodiment illustrated in FIG. 3, a central dividing sheet 11 as before is employed but outer sheets 10' and 12' are each stepped at their peripheries to define open sided chambers 14 and 16, which chambers are closed when sheets 10' and 12' are bonded to sheet 11.

Sheets 10' and 12' are preferably molded into a stepped configuration. This simplified embodiment eliminates the need for dividing strips thus easing assembly.

Bonding of sheets in either embodiment described above is preferably effected by applying a layer of a solvent, such a methylene chloride for cast acrylic. This is injected and spread by capillary attraction between the faces to be bonded. Alternatively a suitable adhesive, for example anaerobic glue, may be used as bonding agent.

Sheets 10' and 12' illustrated in FIG. 3 may be formed by any conventional method such as injection molding, vacuum forming, matched dye molding, hand fabricating or the like.

Sealing of the chambers is most easily effected prior to filling chambers 14 and 16. In order to fill these chambers a filler hole 32 into chamber 14 is provided, there being a similar filler hole into chamber 16, not shown.

The volume of the phases is carefully measured so that phase border 25 is in registry with phase border 29 whereby at rest a single primary color and a single secondary color will be visible. It will be seen that inversion of the device to create movement of the liquids reveals two colors which otherwise would have remained hidden.

In chamber 14 there is provided an upper oil phase 24 and a lower aqueous phase 26 meeting at a clearly defined phase border 25. Oil phase 24 is colored with a yellow dye which is soluble in the oil phase and insoluble in the aqueous phase. There is dissolved a red dye in aqueous phase 26, said dye being soluble in the aqueous phase but insoluble in the oil phase.

Similarly in chamber 16 there is an oil phase 28 and an aqueous phase 30 meeting along border 29. In the embodiment disclosed oil phase 28 is left uncoloured whereas aqueous phase 30 has blue dye in it. Many types of dyes, aqueous phases and oil phases may be employed in chambers 14 and 16. However, it has been found that the combinations set out herein below in Table 1 are most suitable.

TABLE 1

| PHASE NO. | LIQUID | DYE |
|---|---|---|
| 24 | Oleic Acid | Bayer: Ceres Yellow GRN - Solvent Yellow 30 |
| 26 | Ethylene glycol/water | ICI: Procion Red MX5B - Reactive Red 2 |
| 28 | Oleic Acid | None |
| 30 | Ethylene glycol/water | ICI: Procion Turquoise H-A - Reactive Blue 71 |

The dyes listed above are identified both by their manufacturer's trade name and by the colour index generic name. It will be appreciated that many dyes and liquids may be employed and that those listed in Table 1 are merely exemplary.

Referring to FIG. 1 when the device at rest is viewed through both sheet-like chambers 14 and 16 there is presented an upper yellow portion 31 resulting from the juxtaposition of colorless phase 28 and yellow phase 24. There is also presented a lower purple portion 33 resulting from the juxtaposition of red phase 26 next to blue phase 30.

In operation the apparatus is inverted whereupon aqueous phases 26 and 30 descend to what have become the bottoms of their respective chambers 14 and 16. Simultaneously, the oil phases 24 and 28 return to what have now become the upper part of their respective chambers 14 and 16. The flow in either direction is broken into many irregular curvilinear forms in which the actual colours of the dyed liquids are added to by the virtual impression of other colours caused by the superimposition of the images in each of the chambers.

Although in the preferred embodiment use is made of the primary colors it will be seen that the large number of permutations and combinations can be employed such as the use of more than two phases per chamber and/or more than two chambers and the use of other colors to create kinetic abstract patterns whenever the device is inverted.

In another alternative embodiment, not illustrated, the chambers are circular in plan view and provided with a power source for rotating the assembly about an axis. In such an embodiment centrifugal forces during rotation will drive the phase at greater specific gravity outwardly and a "target" effect will be created. It will be seen that through the use of face to face chambers varying color effects can be created.

Many other embodiments an adaptations will be apparent to those skilled in the art.

What I claim is:

1. A decorative device comprising:

a pair of sealed sheet-like chambers in face-to-face relationship, the major portion of each said chamber being transparent; spacing means around the periphery of each sheet for forming said chambers; a pair of mutually immiscible fluid phases of different specific gravities provided in each said chamber;

a first coloring substance homogeneously dissolved in at least one phase in one chamber; a second coloring substance homogeneously dissolved in one phase of the other of said pair of chambers; a third coloring substance homogeneously dissolved in the other phase in one of said chambers; said first, second and third coloring substances being insoluble in the other fluid phase in its respective chamber; and a stand means on at least one end of said pair of chambers for resting said device in an upright position;

the arrangement being such that when said device is at rest there is created a static display of predetermined color combinations and when said apparatus is inverted there is created a kinetic superimposition of irregular images or patterns as each of said pairs of phases returns to equilibrium.

2. The device according to claim 1 wherein said chambers are defined by three sheets of transparent material in registry with one another, there being provided elongate spacing strips around the periphery of each said sheet, said spacing strips being sandwiched on either side by a said sheet of material, the combination being bonded to seal said chambers.

3. The device according to claim 2 wherein there is provided a sealable filler hole in each said chamber.

4. The device according to claim 1 wherein said chambers are each defined by a flat central dividing sheet sandwiched between a pair of open sided chamber sections, each comprising a flat portion having a stepped periphery, the stepped periphery having a flat face lying in a plane parallel to the plane in which said flat portion lies, each said flat periphery face being bonded to said dividing sheet.

5. The device according to claim 4 wherein said chambers are rectangular.

6. The device according to claim 5 wherein there is provided a sealable filler hole in each said chamber.

7. The device according to claim 1 wherein there is in each said chamber an aqueous phase and an oil phase, said aqueous phase comprising an ethylene glycol/water solution and said oil phase comprising Oleic acid.

* * * * *